US005799529A

United States Patent [19]

Kivistöet al.

[11] Patent Number: 5,799,529

[45] Date of Patent: Sep. 1, 1998

[54] METHOD FOR STRAIGHTENING AND MACHINING AN ANODE LUG

[75] Inventors: Tuomo Veikko Kivistö; Tom Erland Marttila, both of Kirkkonummi, Finland

[73] Assignee: WENMBC Systems Oy, Finland

[21] Appl. No.: 578,460

[22] Filed: Dec. 26, 1995

[30] Foreign Application Priority Data

Dec. 30, 1994 [FI] Finland ..... 946168

[51] Int. Cl.[6] ..... B21D 53/00

[52] U.S. Cl. ..... 72/340; 29/874

[58] Field of Search ..... 72/340, 341; 29/882, 29/874, 731; 204/289, 288

[56] References Cited

U.S. PATENT DOCUMENTS

| | | | |
|---|---|---|---|
| 2,150,383 | 3/1939 | MacLagan | 72/340 |
| 3,696,656 | 10/1972 | Nara | 72/420 |
| 4,184,242 | 1/1980 | Petrie | 72/340 |
| 4,903,519 | 2/1990 | Hukkanen | 72/412 |
| 4,946,575 | 8/1990 | Dompas | 204/288 |
| 5,044,192 | 9/1991 | Sanmiya | 72/458 |

*Primary Examiner*—Daniel C. Crane

*Attorney, Agent, or Firm*—Brooks Haidt Haffner & Delahunty

[57] ABSTRACT

The invention relates to the straightening of the lugs of cast anodes, used in the electrolytic refining of metals, prior to immersing the anodes in an electrolytic cell. The method includes straightening of the lugs with both vertical and horizontal compression, and the smoothening of the bottom surface of the anode lug by means of machining.

4 Claims, 1 Drawing Sheet

METHOD FOR STRAIGHTENING AND MACHINING AN ANODE LUG

Figure 1:
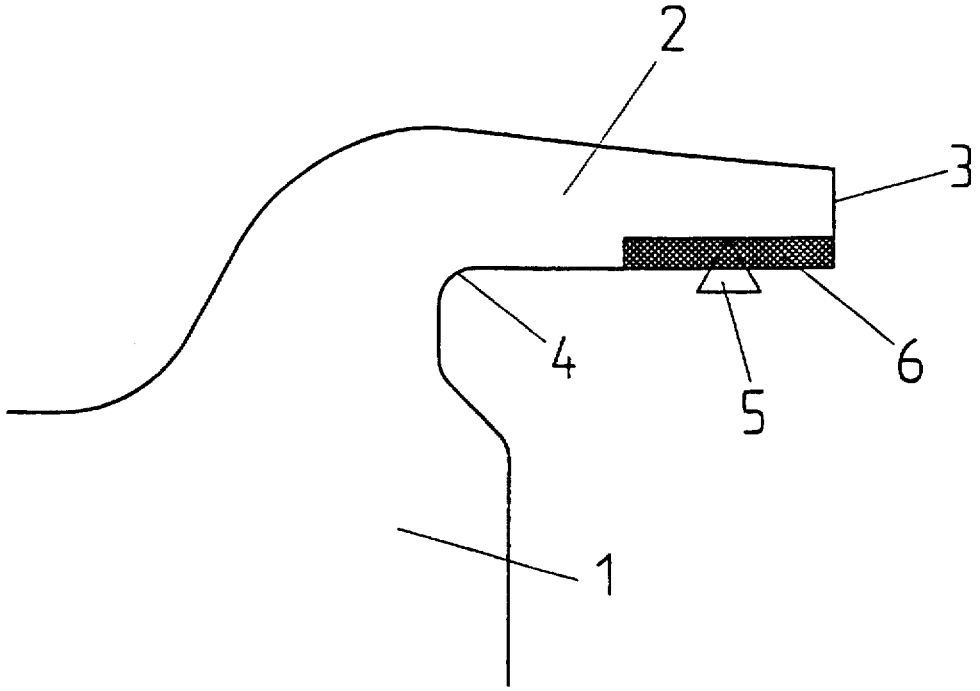

The invention relates to the straightening of lugs in cast anodes used in the electrolytic refining of metals prior to immersing the anodes into an electrolytic cell. The method includes straightening of the lugs by both vertical and horizontal compression, as well as smoothing of the bottom surface of the anode by machining.

The final refining of several metals is carried out with electrolysis. The refining process uses soluble anodes which are produced by casting molten metal into anode molds. The anodes are immersed in the electrolytic cells suspended by their lugs. On top of the first side wall of each cell, there is a busbar, and on top of the second side wall there is provided insulation, and the anode lugs rest on these. The high electric current in the cell proceeds via the contacts in between the busbar and the anode lugs. In order to gain maximum contact and consequently minimum losses, particularly the bottom surfaces of the anode lugs must be smooth and clean.

When the anodes are immersed in the electrolytic cells, there is placed one cathode in between each anode. In practice the distance between an anode and a cathode is only a few tens of millimeters; it is naturally clear that it is essential for the whole electrolytic process to keep this distance as constant as possible throughout the dissolution time of the anodes, so that the current density is evenly distributed. If a short circuit happens in between the anode and the cathode, it interrupts the whole process. In order to distribute the current density as evenly as possible and to avoid short circuits, the anode lugs must keep the anode in vertical position, i.e. the bottom surfaces of the lugs must be at right angle to the anode plate.

Electrolytic plants tend to be large, and therefore the efficiency has a remarkable economic significance. The quality of the contact between the anode lug and the busbar, as well as the regularity of current density, are among the factors that have an essential effect on the efficiency of the electrolysis. The anodes are manufactured by casting, and irrespective of the design of the casting mold, the bottom surface of the solidified anode lug often is uneven. This means that when the anode is suspended on top of the busbar, the contact between the anode and the busbar becomes indeterminate. In order to achieve a sufficiently good contact, the anode lugs must often be treated after casting. The lug must be treated so that the bottom surface thereof is rendered as smooth, clean and perpendicular to the anode plate.

In the prior art, there is known for instance the method and apparatus described in the FI patent publication 86,262 for straightening cast anodes and eliminating casting fins. With the said apparatus, the whole anode is straightened by means of a compression apparatus comprising several elements, and in the process the anode lugs are also straightened both in the vertical and horizontal directions. However, in the course of time casting equipment is improved, so that in most cases the straightening of the whole anode is not necessary at all, but the lugs must always be straightened. What is more, practice has shown that with anode lugs, straightening is generally not enough, but some material must also be removed, because in the transversal direction, the bottom surface of the lug can be slanted owing to a discharge or bend in the mold.

One way of removing material from an anode lug is to cut it off by milling. Due to the nature of milling, all removable material is turned into small chips. A high milling capacity is often required, and therefore the power demand rises fairly high, too. In the milling process, both the anode lug and the milling equipment are subject to strong forces. Among the drawbacks let us mention loud working noise, fast wearing of the cutter heads and bending of the lug in spite of holders; moreover, the whole milling station becomes massive and complicated in construction, which makes it fairly expensive.

It has also been observed that mere machining is not sufficient for the lugs, but the anode lugs are advantageously straightened in connection with the machining process by means of vertical compression to be sufficiently horizontal in order to ensure that the bottom surface of the lug is straightened, but material is not removed more than necessary.

According to the present invention, the bottom surface of an anode lug is machined by means of a cutting method. In connection with the working treatment, the lug is advantageously bent with a vertical pressing motion, so that the lug points somewhat diagonally downwards, i.e. the tip is suitably lower than the foot, but it is also important to straighten the lug in the horizontal direction. The essential novel features of the invention are apparent from the appended patent claims.

Immediately after the vertical and horizontal bending, the bottom surface of the lug is cut, according to the invention, so that the cutting surface is located suitably underneath the foot of the lug, but above the tip. The bending of the lug is carried out prior to the machining, which again takes place before the distributed anodes are immersed in the cell. In this fashion, the treatment ensures that the contact with the busbar is as good as possible, and that the power density is evenly distributed. In a cutting method, such as circular sawing, only a small wedge-like piece is cut off the lug, and the removed material is not turned into small chips as in milling.

With the present sawing method, the power demand for the cutting, as well as forces directed both to the lug and to the working equipment are clearly smaller than with milling. In practice the risk of bending the lug is totally eliminated, and the apparatus itself becomes clearly simpler and lighter in structure. In the performed experiments, where circular saw cutting was applied, the noise level was remarkably lower than for instance in milling, which is due to the large quantity and velocity of teeth in the circular saw in comparison with the cutter heads of a milling cutter. Another factor reducing the noise level is the fact that the working efficiency required in circular sawing is lower than in milling.

Figure 2:
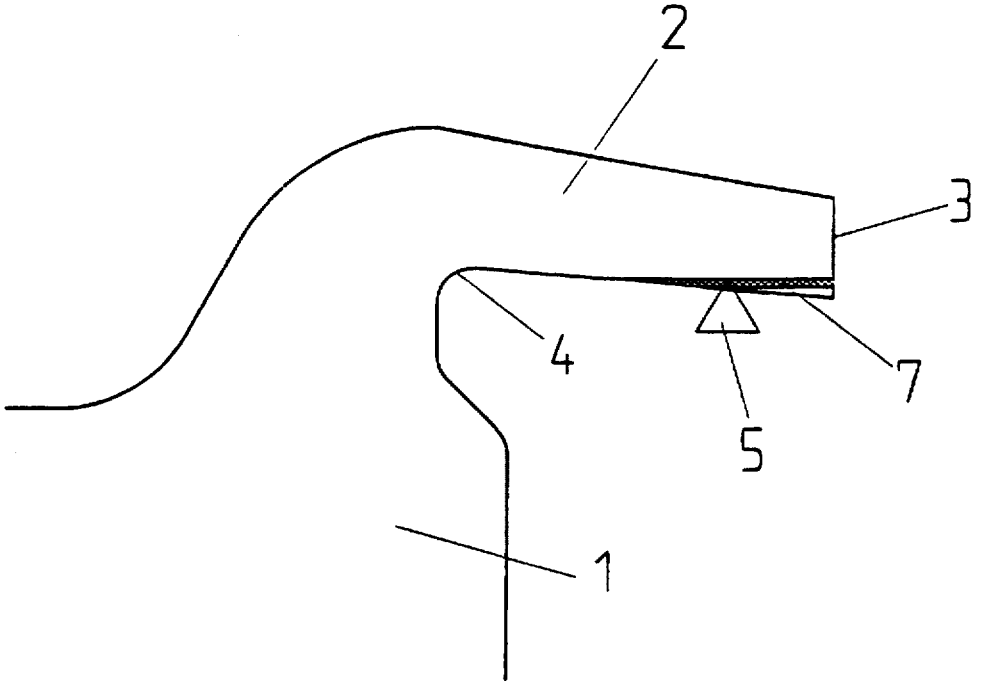

The invention is further described with reference to the appended drawings in principle, wherein FIG. 1 illustrates a prior art method for the working of the anode lug; and FIG. 2 illustrates the working of the lug according to the present invention.

FIGS. 1 and 2 show only a part of the anode 1; in the top part of the said anode, on both sides thereof, there are formed outwardly protruding lugs 2 comprising a tip 3 and a foot 4. The triangle 5 describes the busbar and the parts 7 and 8 the section to be removed. In the smoothening of the bottom surface of the lug according to FIG. 1, carried out by milling, material is removed evenly throughout the whole length under milling, for instance for a thickness of 5 mm. As is seen in FIG. 2, in the sawing process only a small wedge-like piece 7 is removed from the bottom surface of the lug, but the surface obtained with sawing is very smooth and thus ensures a good contact with the busbar. Immediately before sawing, the lug is bent by vertical compression, so that the tip 3 of the lug is slightly lower than the foot 4. It is also advantageous to complete the sawing with a horizontal straightening bending, which also is carried out immediately before the working.

It is naturally clear that the method of machining the lug according to the invention can be automated so that the necessary working steps automatically take place in a successive order, so that the anodes one by one enter the working station, where they are first straightened and then machined.

We claim:

1. A method for straightening and machining the lugs of anodes at one and the same working station prior to moving the anodes to electrolytic cells so that bottom surfaces of the lugs are smooth and clean for providing good electric contact between the lugs and a busbar upon which the bottom surfaces of the lugs rest when the anode has been moved to the electrolytic cell, comprising applying vertical and horizontal compression to the lugs for straightening the lugs and then machining the lugs by a cutting step of sawing.

2. The method according to claim 1 wherein the cutting step is circular sawing.

3. The method according to claim 1 wherein the anode has an anode body and the lugs extend from a foot at the anode body to a tip remote from the anode body, comprising bending the lugs by said vertical compression so that the tip of the lug is displaced downward with respect to the foot of the lug.

4. The method according to claim 1 comprising cutting a wedge-shaped piece from the bottom surface of the anode lug.

* * * * *

UNITED STATES PATENT AND TRADEMARK OFFICE

CERTIFICATE OF CORRECTION

PATENT NO. : 5,799,529

DATED : September 1, 1998

INVENTOR(S) : TUOMO VEIKKO KIVISTÖ ET AL.

It is certified that error appears in the above-identified patent and that said Letters Patent is hereby corrected as shown below:

Title page:

[73] Assignee, change "WENMBC" to --WENMEC--.

Signed and Sealed this

Fourth Day of May, 1999

*Attest:*

*Attesting Officer*

Q. TODD DICKINSON

*Acting Commissioner of Patents and Trademarks*